US005903656A

United States Patent [19]

D'Hoogh et al.

[11] Patent Number: 5,903,656

[45] Date of Patent: May 11, 1999

[54] MONITOR HAS TUBULAR LOUDSPEAKER REDUCING CRT'S MASK VIBRATIONS

[75] Inventors: Guido O. M. D'Hoogh, Dendermonde, Belgium; Achiel E Verheyen, Cupertino, Calif.

[73] Assignee: Philips Electronics North America Corporation, New York, N.Y.

[21] Appl. No.: 08/815,252

[22] Filed: Mar. 12, 1997

[30] Foreign Application Priority Data

May 31, 1996 [EP] European Pat. Off. ..... 96201518
May 31, 1996 [EP] European Pat. Off. ..... 96201519

[51] Int. Cl.[6] ..... H04R 1/02

[52] U.S. Cl. ..... 381/333; 381/306; 381/403; 381/404

[58] Field of Search ..... 381/306, 333, 381/403, 404; 181/153, 196, 197

[56] References Cited

U.S. PATENT DOCUMENTS

| | | | |
|---|---|---|---|
| 4,318,025 | 3/1982 | Penird et al. | 313/404 |
| 5,103,132 | 4/1992 | Van Der Bolt et al. | 313/402 |
| 5,315,208 | 5/1994 | Van Der Bolt et al. | 313/407 |
| 5,479,520 | 12/1995 | Nieuwendijk et al. | 381/306 |

*Primary Examiner*—Forester W. Isen
*Attorney, Agent, or Firm*—Peter Verdonk

[57] ABSTRACT

A loudspeaker system is physically integrated with a monitor. The monitor has a CRT. The loudspeaker system comprises an electro-acoustic transducer, a passive radiator and a tube mounted in between. The tube has a circular cross-section. The tube has an axis that is in parallel with a plane of the CRT's shadow mask.

9 Claims, 5 Drawing Sheets

MONITOR HAS TUBULAR LOUDSPEAKER REDUCING CRT'S MASK VIBRATIONS

FIELD OF THE INVENTION

The invention relates to a combination of a monitor and a loudspeaker system.

BACKGROUND ART

Examples of such combinations are television sets and computer monitors. Typically, the monitor comprises a cathode-ray-tube (CRT). A problem that may occur if loudspeakers are integrated with such a monitor relates to the acoustic coupling between the loudspeaker and the monitor's shadow mask. To explain this in a more detail, the configuration of a CRT and the working of a bass-loudspeaker are discussed below.

A CRT includes an electron gun, deflection coils and a screen. The inside of the screen is coated with light-sensitive phosphors. In color CRTs; the phosphors comprise red, blue and green crystals arranged in triads of each one of the colored phosphors. The electron gun generates three beams, one for each color, which directed by the deflection coils scan the screen moving from left to right and up and down. The phosphors light up in the relevant color when illuminated by the beams. In order to produce a correctly colored image, each electron beam must hit only the appropriate colored phosphor. To ensure such accuracy, the shadow mask is used as a filter. The shadow mask is a metal plate of the same shape as the screen and with the same number of holes as the number of triads on the screen. Each hole has a corresponding triad of phosphors which prevents adjacent triads from being influenced.

A loudspeaker is an electro-acoustic transducer, i.e., a device for converting electrical energy into acoustic energy by moving a diaphragm under control of an electric signal. The moving diaphragm displaces a volume of air, the resulting pressure variations being perceived as sound. As known in the art, loudspeakers are mounted in an enclosure or speaker cabinet.

The CRT's mask turns out to be susceptible to frequencies in the audio spectrum, i.e., it will resonate at particular frequencies. This mechanical vibration adversely affects the quality of the picture being displayed due to the resulting misalignment between the mask's holes and the corresponding triads on the screen. Sound waves may be incident on the CRT through the air or via mechanical contact, directly or indirectly, between the CRT and the loudspeaker. The problem is mostly noticeable in the low and middle frequency ranges.

Several solutions are known to the well known problem of vibrating masks. For example, U.S. Pat. No. 4,318,025 suggests to suspend the mask from the screen through an absorbing material. U.S. Pat. No. 5,103,132 and U.S. Pat. No. 5,315,208 propose using a specific supporting frame to reduce the mask's sensitivity to vibrations (Philips prior art).

Although the problems are mostly noticeable in CRTs, other types of monitors may also be affected by undesired vibrations of their components caused by acoustic interaction with a nearby loudspeaker system.

OBJECT OF THE INVENTION

It is an object of the invention to provide an alternative solution to the problem described above.

SUMMARY OF THE INVENTION

To this end, the invention provides an apparatus having a combination of an electronic display device or monitor, and a loudspeaker system. The loudspeaker system comprises a transducer and a tubular housing. The transducer is located substantially at an end of the tubular housing. The tubular housing or enclosure of the transducer includes a hollow elongated cylinder. The cylinder is mechanically very rigid in the radial direction. Radial oscillations will therefore hardly occur. Especially if the tubular housing has a substantially circular cross-section, its resistance to radial oscillations is maximum. Accordingly, the problem is tackled at the origin: if there is less vibration in the tube's material, there is less to transfer to its environment through mechanical or acoustic coupling. In order to have the combination fit in the monitor for an apparatus such as a television set or a computer user-interface, the tubular housing may be slightly deformed (e.g., its axis can be bent, its cross-section can be made to deviate slightly from the circular form) without degrading audio performance and without substantially decreasing resistance to radial oscillations, thus optimally using the space available inside the monitor or inside the apparatus. Preferably, the tubular housing is mounted so that its axis is substantially in parallel with a plane of a front panel of the monitor. The CRT's shadow mask is sensitive to vibrations perpendicular to its plane. By mounting the tubular housing so that its axis is substantially in parallel with the mask, the mechanical coupling between the loudspeaker and the CRT is minimized. The reason for this is that the forces that arise during operation of the loudspeaker device point along this axis. The tubular housing can, but need not, be elastically attached to an interior or exterior of the monitor. Experiments have shown that the acoustic coupling of loudspeaker to the mask is negligible if the tubular housing is mounted in aforesaid proper orientation with respect to the mask, even when no elastic or shock absorbing means is used to attach the tube to the monitor's interior.

Preferably, the other end of the tubular housing is provided with a passive radiator. This enhances audio performance, but also admits smaller sized combinations than are possible with a closed housing or a vented enclosure while maintaining performance.

Preferably, at least the transducer or the passive radiator is of the telescopic kind, that enables large displacements of air combined with small size. In a telescoping radiator or transducer, the cone is suspended from a sub-frame, and the sub-frame is suspended from the chassis, directly or through one or more other sub-frames. The cones of the transducer and passive radiator are moveable with regard to a respective sub-frame and the sub-frame is moveable with regard to the chassis. Thus, a large displacement volume is combined with a small diameter of the cone, owing to the accumulation of the individual amplitudes of one or more sub-frames and of the cone. Such a loudspeaker with telescoping transducer and passive radiator for use in a monitor has a volume of 1 U.S. quart (1 liter).

BRIEF DESCRIPTION OF THE DRAWINGS

The invention is explained by way of example and with reference to the accompanying drawings, wherein.

PREFERRED EMBODIMENTS

Apparatus

Figure 1:
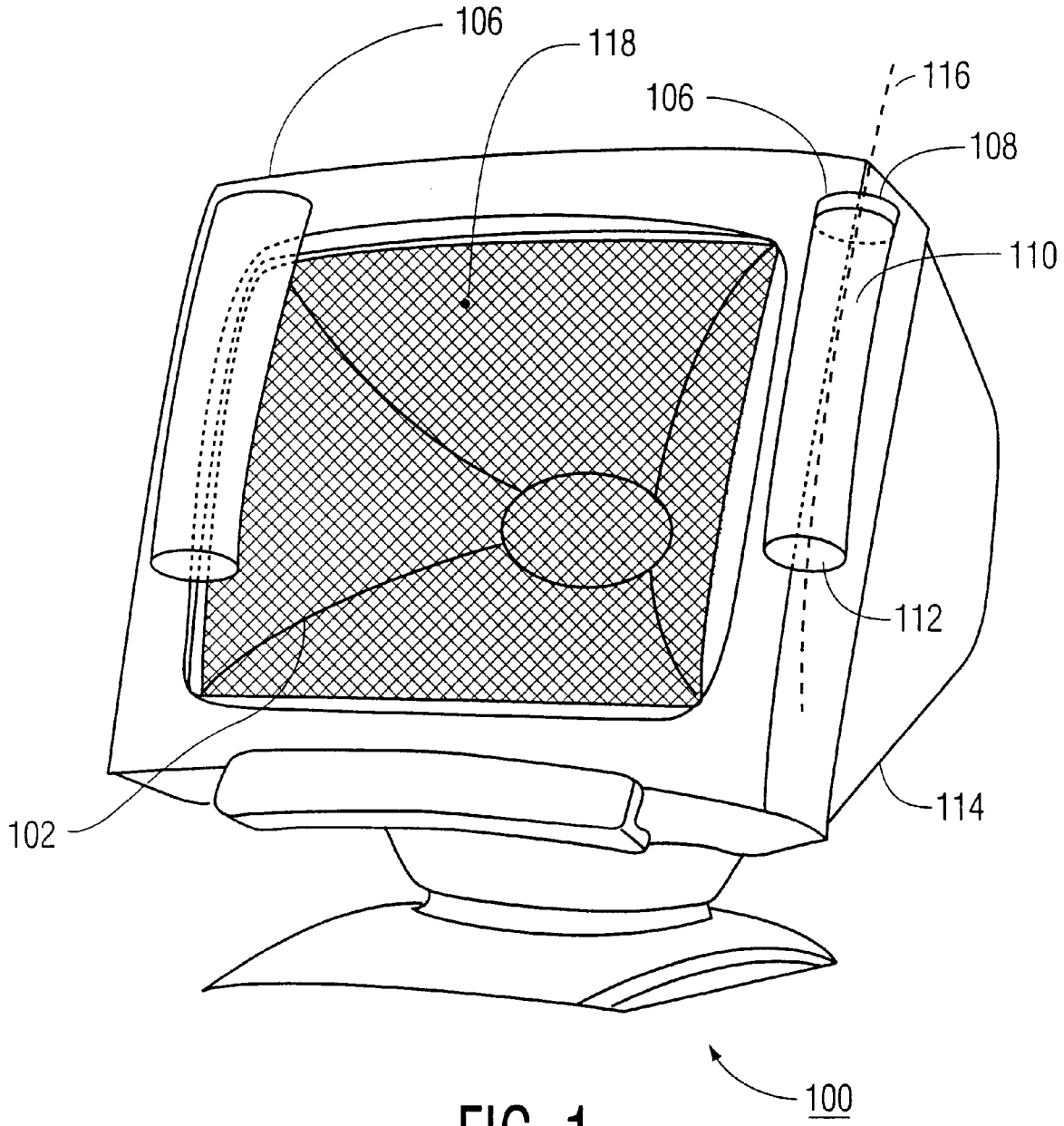
FIG. 1 is a diagram of an apparatus according to the invention.

FIG. 1 is a diagram in ghost view of an apparatus 100 of the invention. Apparatus 100 comprises a monitor or display device with a CRT 102, and with a loudspeaker system that includes loudspeaker devices 104 and 106. Devices 104 and 106 both have the same configuration in this example, and speaker device 106 is discussed in more detail below.

Speaker device 106 comprises an electro-acoustic transducer 108 mounted at one end of a tube 110, and a passive radiator 112 mounted at the other end. Tube 110 has a substantially circular cross-section. Tube 110 is made out of, e.g., aluminum or a synthetic material. Tube 110 can be slightly bent to fit in housing or enclosure 114 of the monitor. Openings (not shown) are provided, e.g., at the top of enclosure 114, to radiate the acoustic energy out of enclosure 114. Tube 110 has sufficiently high resistance to radial oscillations, thus reducing the passing on of sound waves to the interior of CRT 102 either due to the waves propagating through the air or through direct of indirect mechanical contact between tube 110 and CRT 102.

Transducer 108 and radiator 112 are of a conventional type. Alternatively, at least transducer 108 or passive radiator 112 is of the telescopic kind, that enables large displacements of air combined with small size. The cone in a telescoping radiator or transducer is suspended from a sub-frame, and the sub-frame is suspended from a chassis, directly or through one or more other sub-frames. The cones of the transducer and passive radiator are moveable with regard to a respective sub-frame and the sub-frame is moveable with regard to the chassis. Thus, a large displacement volume is combined with a small diameter of the cone, owing to the accumulation of the individual amplitudes of one or more sub-frames and of the cone. This telescoping operation is explained with reference to FIGS. 2 and 3. The combination of such a telescoping configuration mounted on a tubular base is highly suitable for being accommodated in a monitor owing to the combination's small size, high performance and mechanical rigidity relating to undesired radiation.

Tube 110 of loudspeaker device 106 has a longitudinal axis 116 that defines a spatial orientation of tube 110. Tube 110 is mounted in such a way that axis 116 is in parallel with a plane of the front panel of CRT 102. That is, axis 116 is in parallel with mask 118 of CRT 102. Loudspeaker device 104 is mounted similarly. By mounting the tubular housing so that its axis lies substantially parallel to mask 118, the mechanical coupling between the loudspeaker and the CRT is minimized. More specifically, the forces arising during operation of the loudspeaker device 106 point along axis 116. In the example of FIG. 1, devices 104 and 106 are shown having their tubes mounted in parallel with each other in the vertical direction, and in parallel with mask 118. Both devices 104 and 106 could also be mounted horizontally, and in parallel with each other and in a plane parallel to mask 118. Alternatively, devices 104 and 106 could be arranged so that their axes are both in parallel with mask 118 but make an angle with respect to each other.

It is clear that more than two loudspeaker devices such as 104 and 106 can be mounted inside enclosure 114 provided that there is enough room. Experiments show that a typical order of magnitude for the volume of device 104 or 106 is 1 U.S. quart (1 liter).

Loudspeaker system

Figure 2:
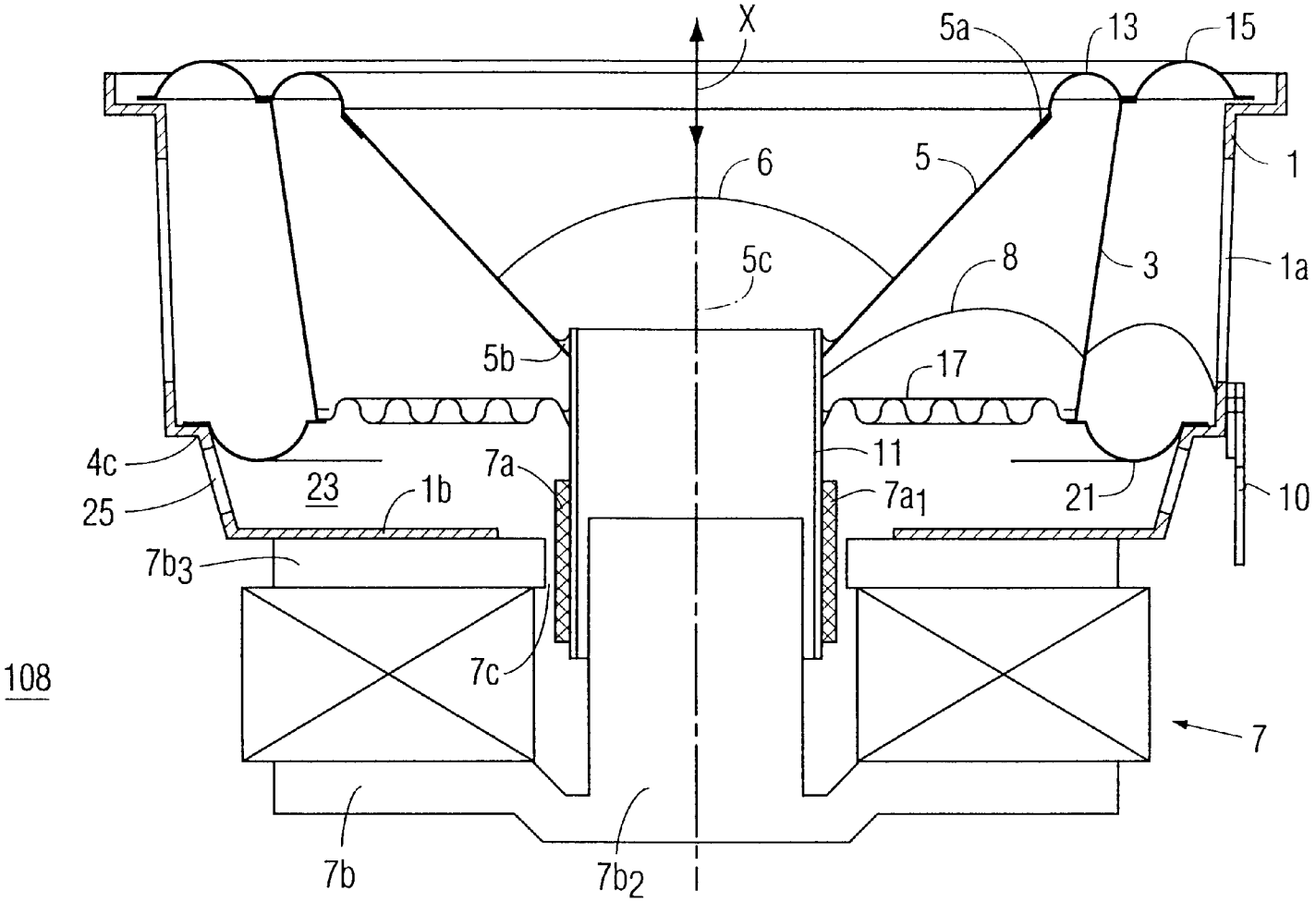
FIGS. 2 and 3 are diagrams of telescoping transducer.

FIG. 2 shows an embodiment of transducer 108. Transducer 108 comprises a chassis 1 with sound apertures 1*a* and a conical diaphragm 5 located within chassis 1. Diaphragm 5 has an open front part 5*a* and a back part 5*b*, arranged opposite this front part. Transducer 108 further comprises an electromagnetic actuator 7 having a first actuator part 7*a* connected to back part 5*b*, and a second actuator part 7*b* connected to chassis 1. Actuator parts 7*a* and 7*b* cooperate magnetically with one another via an air gap 7*c* during operation. Transducer 108 further comprises a sub-frame 3 extending between chassis 1 and diaphragm 5, a first flexible connecting element 13 connecting diaphragm 5 to sub-frame 3, and a second flexible connecting element 15 connecting sub-frame 3 to chassis 1 at the location of front part 5*a*. At the location of back part 5*b* a flexible centering element 17 connects diaphragm 5 to sub-frame 3, in the present example via a central element 11 secured to diaphragm 5. A flexible connecting element 21 connects sub-frame 3 to chassis 1. Connecting element 21 and connecting elements 13 and 15 each take the form of an omega-shaped rim of a flexible material, particularly polyurethane, connecting element 21 and facing connecting element 15 being arranged in mirror-inverted positions relative to one another. Centering element 17 and connecting elements 13, 15 and 21 form such a suspension for diaphragm 5 that the latter is moveable almost exclusively along its central axis 5*c*, i.e. in the directions x.

First actuator part 7*a* of actuator 7 comprises a coil 7*a*1 secured to element 11 and connected to terminals 10 via an electrical conductor B. Second actuator part 7*b* comprises a permanent magnet 7*b*1 and soft-magnetic yoke parts 7*b*2 and 7*b*3. Second actuator part 7*b* is secured to a base 1*b* of chassis 1. If desired, first actuator part 7*a* may comprise a magnet instead of a coil, and second actuator part 7*b* may comprise a coil instead of a magnet. The magnet of actuator 7 may optionally be replaced by a coil. A space 23 provided between centering element 17 and connecting element 21 on the one hand, and actuator 7 on the other hand, communicates with the surrounding space via one or more sound apertures 25 in a chassis part 1*c*. As a result of this configuration, diaphragm 5 performs well-defined axial movements relative to sub-frame 3, and sub-frame 3 performs well defined axial excursions relative to chassis 1, thus giving rise to the telescoping operation.

Figure 3:
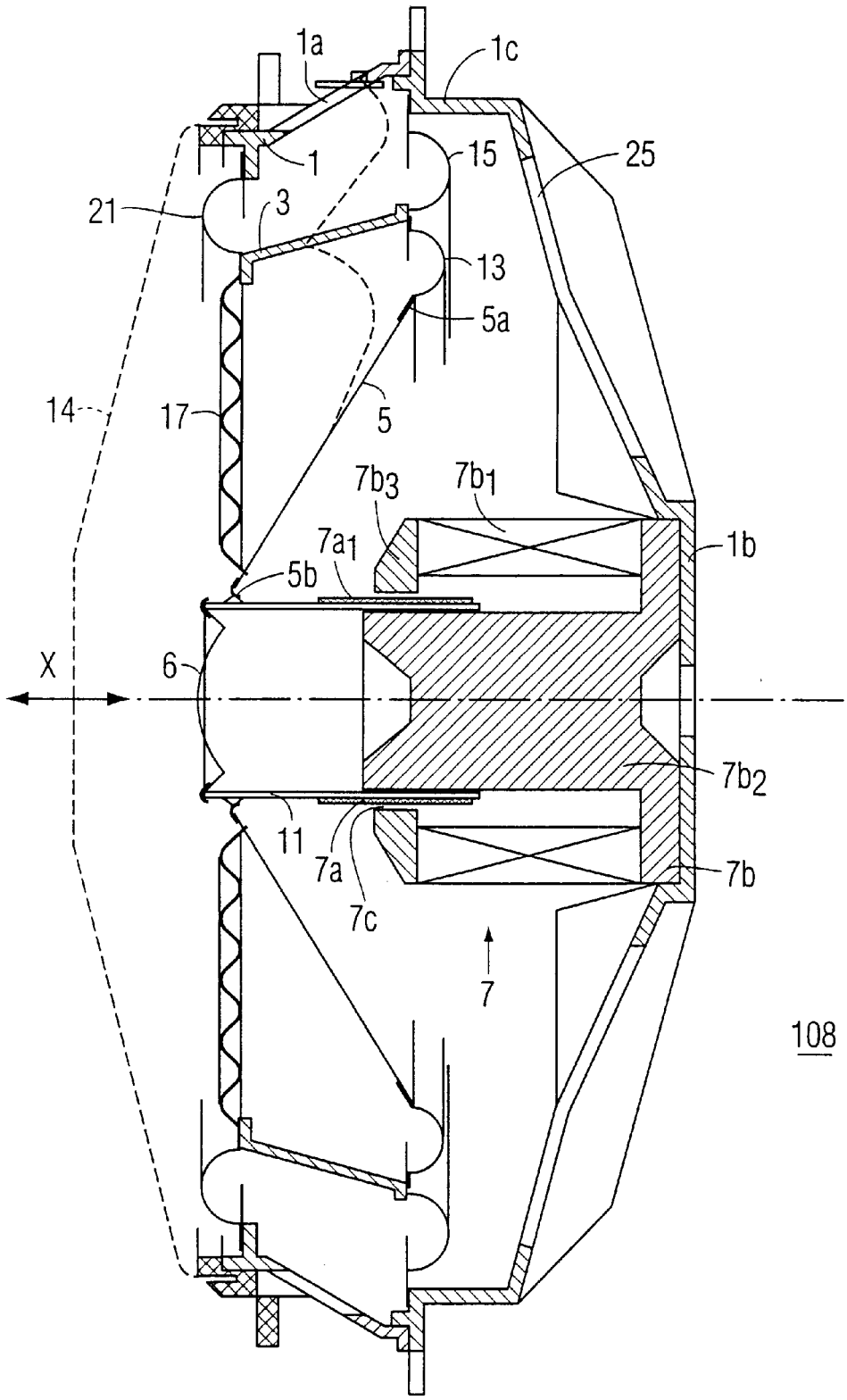

FIG. 3 shows another embodiment of transducer 108. Transducer 108 comprises a chassis 1 having a chassis part 1*b* forming the base and a chassis part 1*c* forming a circumferential wall. Chassis 1 has sound apertures 1*a* and 25. Transducer 108 further comprises a diaphragm 5 having a first part 5*a* forming the front part and a second part 5*b* forming the back part. Diaphragm 5 is tapered from first part 5*a* to second part 5*b*. Front part 5*a* is open and has been provided with a central sleeve-shaped or cylindrical part 11. Transducer 108 further comprises a sub-frame 3 extending between diaphragm 5 and chassis 1. Near its front part 5*a* diaphragm 5 is suspended from sub-frame 3 by a first flexible connecting element 13. At the location of front part 5*a*, sub-frame 3 is suspended from chassis 1 by means of a second flexible connecting element 15. Furthermore, at the location of back part 5*b* of diaphragm 5 sub-frame 3 is secured to chassis 1 via a flexible suspension member 21. A flexible centering element 17 extends between sub-frame 3 and back part 5*b*. The combination of sub-frame 3, elements 13, 15 and 17 and member 21 allow a large excursion of diaphragm 5 relative to chassis 1 in the directions x. An electromagnetic actuator 7 has been provided to drive diaphragm 5. Actuator 7 has a first actuator part 7*a* connected to diaphragm 5 via a connection to the central element 11 of back part 5*b*. Actuator 7 has a second actuator part 7*b* connected to chassis 1 via a connection to base 1*b* of chassis 1. First actuator part 7*a* comprises a coil 7*a*1, which extends in an air gap 7*c* of a magnetic yoke of second actuator part 7*b*. The yoke comprises soft-magnetic parts 7*b*2 and 7*b*3. Second actuator part 7*b* further comprises a ring-shaped permanent magnet 7*b*1. Back part 5*b* of diaphragm 5 is provided with a dust cap 6 which seals against dust. In the present example, transducer 108 further comprises a protective grill 14.

Figure 4:
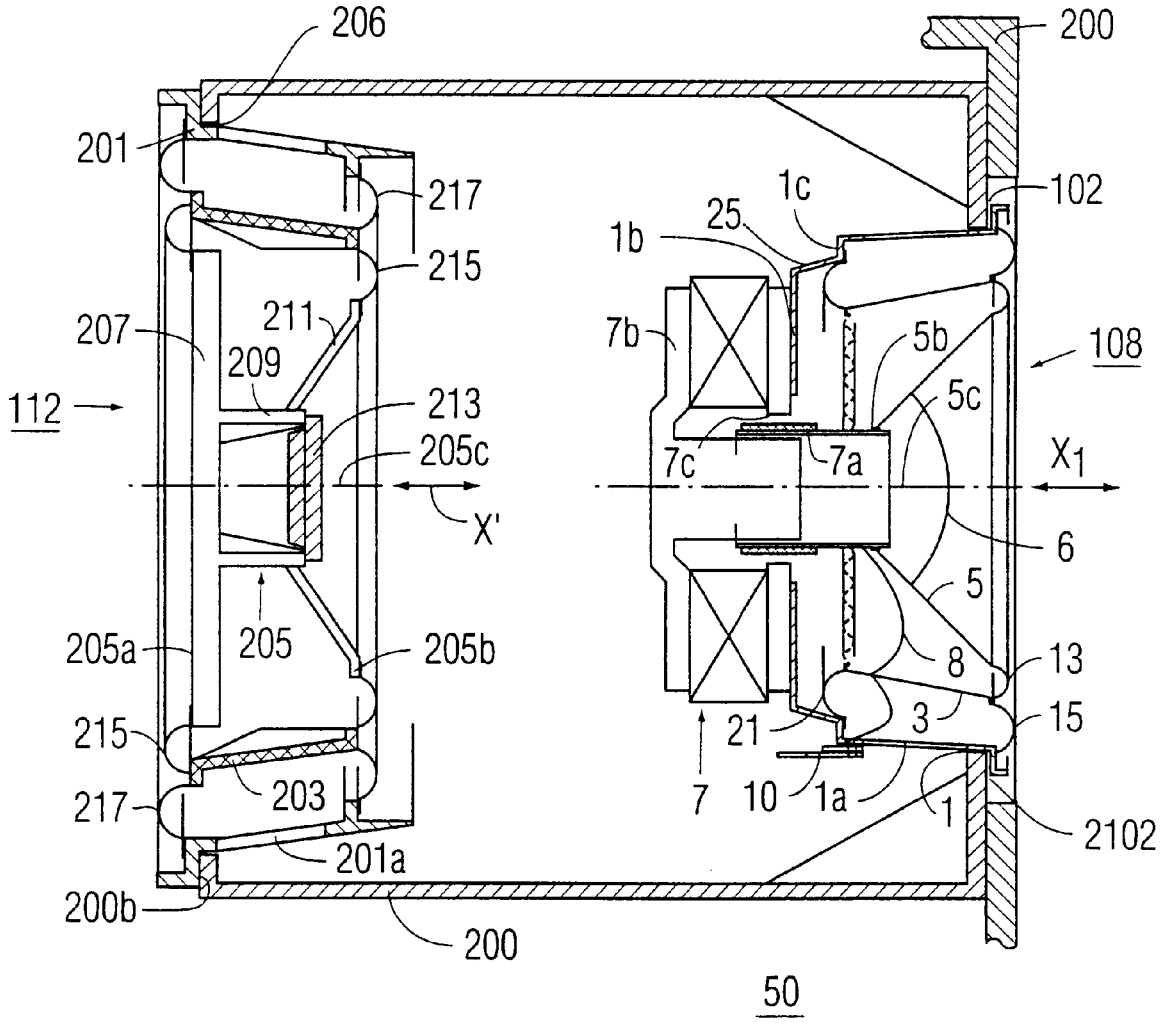
FIG. 4 is a diagram of a loudspeaker system with a transducer and a passive radiator.

FIG. 4 shows a combination 50 of a transducer 108 and passive radiator 112. Combination 50 comprises a housing or enclosure 200, which accommodates transducer 108, in the present example the embodiment of FIG. 2. Housing 200 has an opening 202 through which chassis 1 of transducer 108 extends. Chassis 1 is secured to an edge portion 210*a* of housing 200 around opening 202. For a further description of transducer see the description of FIG. 2.

Combination 50 is constructed, by way of example, as a bass-reflex loudspeaker system and comprises passive radiator 112. For this purpose, housing 200 has a further opening 206, through which a chassis 201 of passive radiator 112 extends. Chassis 201 is secured to an edge portion 200*b* of the housing 200 around opening 206. Passive radiator 112 further comprises a sub-frame 203 and a mass element 205. Chassis 201 may have apertures 201*a*. Sub-frame 203 in the present example is formed by an imperforate solid of revolution. Mass element 205 comprises, e.g., a plate-shaped or disc-shaped part 207, a cylindrical central part 209 and a conical part 211. Central part 209 carries a tuning mass 213 by means of which the desired Helmholtz resonance of the system is tuned. Mass element 205 has a front part 205*a* and a back part 205*b*. Passive radiator 112 further comprises first flexible connecting elements 215, which connect mass element 205 flexibly to sub-frame 203, and second connecting elements 217, which connect sub-frame 203 flexibly to chassis 201. First connecting elements 215 connect both front part 205*a* and back part 205*b* of mass element 205 to sub-frame 203. Second connecting elements 217 connect sub-frame 203 to chassis 201 both at the location of front part 205*a* and at the location of the back part 205*b*. In this example connecting elements 215 and 217 take the form of ring-shaped rims of omega-shaped cross-section. First connecting elements 215 as well as second connecting elements 217 are disposed in mirror-inverted positions relative to one another. The rims are made of polyurethane or of another suitable material, such as rubber. Under the influence of pressure variations produced by transducer 108, mass element 205 performs axial movements x' along its central axis 205*c*, the amplitude being the sum of the maximum excursion of mass element 205 relative to the sub-frame 203 and the maximum excursion of sub-frame 203 relative to chassis 201. Instead of passive radiator 112 shown, another, non-telescoping, type of passive radiator can be used.

Note that central axis 205*c* of passive radiator 112 and axis 5*c* of transducer 108 are in a direct line with each other. Axes 205*c* and 5*c* define axis 116 shown in FIG. 1. Thus, the forces that arise from the operation of loudspeaker device 106 are made to point along axis 116.

Elements 205, 107, 209 and 213 could have other shapes different from those specified above and from those shown in the drawing, dependent on ease of manufacturing said elements and ease of assembling the radiator.

Passive radiator

Figure 5:
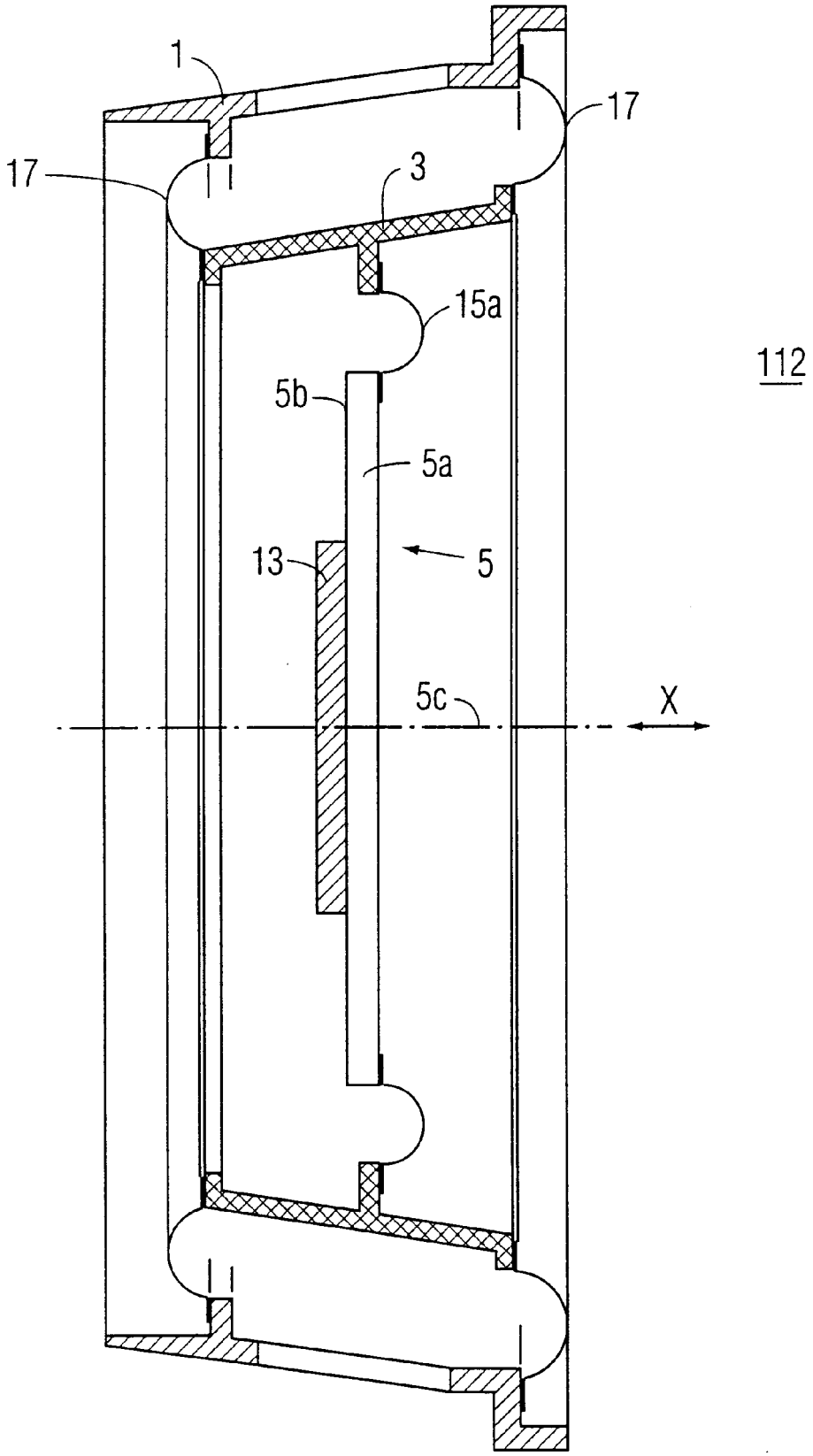
FIG. 5 is a diagram of a passive radiator.

FIG. 5 is a diagram of a further embodiment of a telescoping passive radiator 112. Radiator 112 comprises a chassis 1, a mass element 5 and a sub-frame 3, which extends between chassis 1 and mass element 5. Mass element 5 has a front part 5*a* and a back part 5*b*. Mass element 5, which is flat in the present example, is connected to sub-frame 3 by means of a first flexible connecting member 15*a*. Sub-frame 3 is connected to chassis 1 by means of a second flexible connecting member comprised of two flexible connecting elements 17. Both connecting members are flexible and compliant in directions parallel to central axis 5*c* of the mass element. As a result, axial movements of mass element 5 are determined by axial movements of mass element 5 relative to sub-frame 3 and of sub-frame 3 relative to chassis 1. Connecting member 15*a* and connecting elements 17 in the present example are formed by ring-shaped bodies of omega-shaped cross-section, which present a comparatively high resistance to lateral deformations, i.e. deformations in radial directions with respect to the central axis. One of the parts of mass element 5, in the present example back part 5*b*, carries a tuning mass.

We claim:

1. A loudspeaker system comprising an electro-acoustic transducer and a tubular housing, wherein the transducer is located substantially at an end of the tubular housing, the transducer comprising:

a chassis physically integrated with the tube;

a diaphragm having a front part and a back part and located within the chassis;

an electromagnetic actuator comprising a first actuator part connected to the back part of the diaphragm and a second actuator part connected to the chassis to cooperate with the first actuator part via an air gap;

a telescoping arrangement coupled between the chassis and the diaphragm; and suspension means for flexibly suspending the diaphragm from the chassis via the telescoping arrangement.

2. The system of claim 1, comprising a passive radiator located substantially at the other end of the tubular housing.

3. The system of claim 1, wherein the passive radiator comprises:

a further chassis physically integrated with the tube;

a mass element having a front part and a back part and located within the further chassis;

a further telescoping arrangement coupled between the further chassis and the mass element; and further suspension means for flexibly suspending the mass element from the further chassis via the further telescoping arrangement.

4. The system of claim 1, wherein the tubular housing has a substantially circular cross-section.

5. An apparatus with a combination of a monitor and a loudspeaker system, wherein the loudspeaker system comprises an electro-acoustic transducer, and a tubular housing, the transducer being located substantially at an end of the tubular housing, the transducer comprising:

a chassis physically integrated with the tube;

a diaphragm having a front part and a back part and located within the chassis;

an electromagnetic actuator comprising a first actuator part connected to the back part of the diaphragm and a second actuator part connected to the chassis to cooperate with the first actuator part via an air gap;

a telescoping arrangement coupled between the chassis and the diaphragm; and suspension means for flexibly suspending the diaphragm from the chassis via the telescoping arrangement.

6. The apparatus of claim 5, comprising a passive radiator located substantially at the other end of the tubular housing.

7. The apparatus of claim 6, wherein the passive radiator comprises:

a further chassis physically integrated with the tube;

a mass element having a front part and a back part and located within the further chassis;

a further telescoping arrangement coupled between the further chassis and the mass element; and further suspension means for flexibly suspending the mass element from the further chassis via the further telescoping arrangement.

8. The apparatus of claim 5, wherein:

the monitor has a front panel; and the tubular housing is mounted so that its axis is in parallel with a plane of the front panel.

9. The apparatus of claim 5, wherein the tubular housing has a substantially circular cross-section.

* * * * *